US006883240B2

(12) United States Patent
Russell et al.

(10) Patent No.: US 6,883,240 B2
(45) Date of Patent: Apr. 26, 2005

(54) BOREHOLE SURVEYING

(75) Inventors: Anthony W. Russell, Turriff (GB); Michael K. Russell, Cheltenham (GB)

(73) Assignee: Smart Stabilizer Systems Limited, Ashchurch (GB)

( * ) Notice: Subject to any disclaimer, the term of this patent is extended or adjusted under 35 U.S.C. 154(b) by 0 days.

(21) Appl. No.: 10/666,314

(22) Filed: Sep. 18, 2003

(65) Prior Publication Data

US 2004/0107590 A1 Jun. 10, 2004

(30) Foreign Application Priority Data

Sep. 19, 2002 (GB) ..... 0221753

(51) Int. Cl.[7] ..... E21B 47/022
(52) U.S. Cl. ..... 33/313; 175/45
(58) Field of Search ..... 33/302–304, 313; 175/45; 73/152.42

(56) References Cited

U.S. PATENT DOCUMENTS

| | | | | |
|---|---|---|---|---|
| 4,510,696 A | | 4/1985 | Roesler | |
| 4,611,405 A | * | 9/1986 | Van Steenwyk | 33/304 |
| 4,682,421 A | | 7/1987 | van Dongen | |
| 4,706,388 A | * | 11/1987 | Van Steenwyk | 33/304 |
| 4,819,336 A | | 4/1989 | Russell | |
| 4,999,920 A | | 3/1991 | Russell et al. | |
| 5,314,030 A | | 5/1994 | Peterson et al. | |
| 5,398,421 A | | 3/1995 | Nicolle et al. | |
| 5,435,069 A | | 7/1995 | Nicholson | |
| 5,469,736 A | | 11/1995 | Moake | |
| 5,606,124 A | | 2/1997 | Doyle et al. | |
| 5,646,611 A | | 7/1997 | Dailey et al. | |
| 6,065,218 A | | 5/2000 | Edwards | |
| 6,631,563 B1 | * | 10/2003 | Brosnahan et al. | 33/313 |
| 6,637,119 B1 | | 10/2003 | Russell et al. | |
| 2002/0078745 A1 | | 6/2002 | Russell | |
| 2002/0112887 A1 | * | 8/2002 | Harrison | 175/45 |

FOREIGN PATENT DOCUMENTS

| | | |
|---|---|---|
| EP | 0387991 A2 | 9/1990 |
| EP | 0 846 841 A3 | 9/1999 |
| GB | 2094484 A | 9/1982 |
| GB | 2 122 751 A | 1/1984 |
| WO | WO 99/66173 A1 | 12/1999 |

OTHER PUBLICATIONS

Alison Bourne, The UK Patent Office, Patents Act 1977 Search Report under Section 17, Aug. 23, 2002, UK (one page).

* cited by examiner

*Primary Examiner*—G. Bradley Bennett
(74) *Attorney, Agent, or Firm*—Mark A. Oathout

(57) ABSTRACT

The invention relates to a method and an apparatus for use in surveying boreholes. The method of the invention comprises the following steps: providing an instrument package in a leading end of a drillstring, the instrument package comprising first and second single-axis sensors mounted for rotation with the drillstring about the rotational axis of the drillstring, the first sensor being an accelerometer and the second sensor being a magnetic fluxgate or a rate gyro; rotating the drillstring; deriving from the first sensor the inclination angle of the drillstring at the instrument package; and deriving from the second sensor the azimuth angle of the drillstring at the instrument package.

12 Claims, 4 Drawing Sheets

$V(t) = K1.\cos(w.t) + K2$

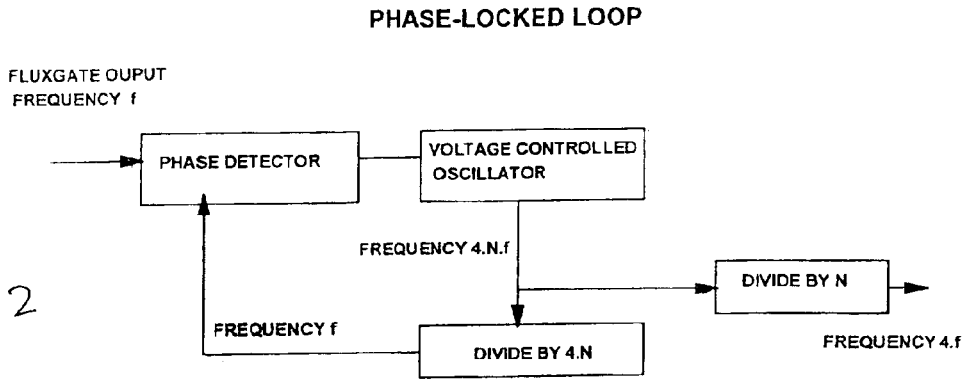
FIG. 2
FIG. 3
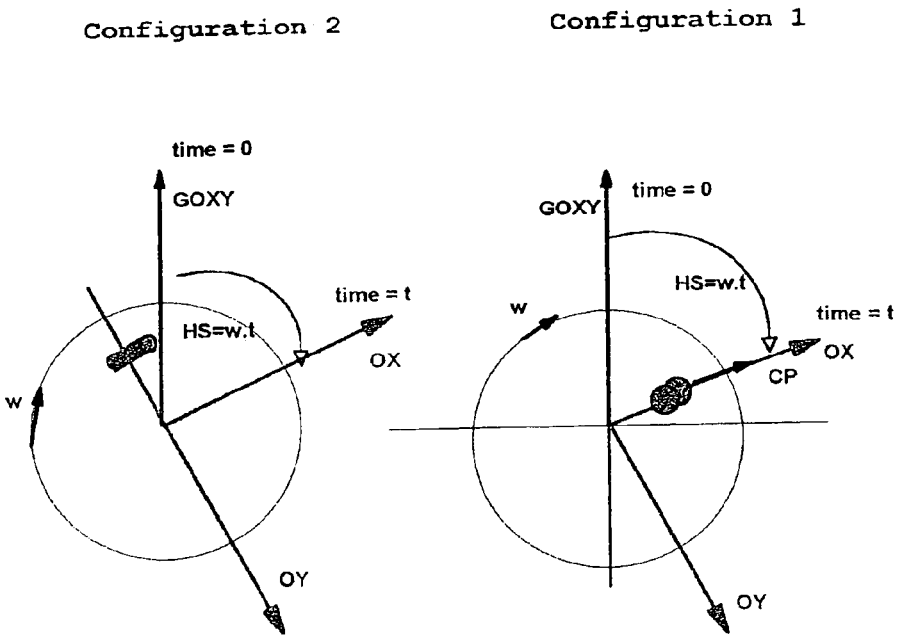

BOREHOLE SURVEYING

This invention relates to a method and apparatus for use in surveying of boreholes.

It is known in directional drilling, for example, to detect the orientation of a drillstring adjacent to the bit by means of a sensor package for determining the local gravitational [GX,GY,GZ] and magnetic [BX,BY,BZ] field components along mutually orthogonal axes, and to derive from these the local azimuth (AZ) and inclination (INC) of the drillstring. Conventionally, the measurements are made by providing within the instrument package three mutually perpendicular accelerometers and three mutually perpendicular magnetic fluxgates.

The present invention is concerned with an arrangement which requires only two measurement devices, namely a single accelerometer and a single magnetic fluxgate or a single accelerometer and a single rate gyro, the latter being preferred for situations in which magnetic interference is likely to be encountered.

Accordingly, the present invention provides a method of surveying boreholes, comprising:

providing an instrument package in the leading end of a drillstring, the instrument package comprising first and second single-axis sensors mounted for rotation with the drillstring about the rotational axis of the drillstring, the first sensor being an accelerometer and the second sensor being a magnetic fluxgate or a rate gyro;

rotating the drillstring;

deriving from the first sensor the inclination angle of the drillstring at the instrument package; and deriving from the second sensor the azimuth angle of the drillstring at the instrument package.

Each of the sensors will typically be positioned in one of two configurations. In the first configuration, the sensor is radially spaced from the borehole axis and has its sensing axis in a plane containing the borehole axis and an axis perpendicular thereto. In the second configuration, the sensor is radially spaced from the borehole axis and has its sensing axis in a plane parallel with the borehole axis.

Preferably, the drilling control rotation angle is also obtained from the sensor outputs.

Preferably, the sensor outputs are integrated over the four quadrants of rotation and the desired output angle is derived from the integrated output. The instrument package suitably includes rotation angle reference means for use in the integration.

Additional information may be derived, such as the local gravitational and magnetic field vectors.

From another aspect, the invention provides apparatus for use in surveying boreholes, the apparatus comprising an instrument package adapted to be included in the leading end of a drillstring, the instrument package comprising first and second single-axis sensors mounted for rotation with the drillstring about the rotational axis of the drillstring, the first sensor being an accelerometer and the second sensor being a magnetic fluxgate or a rate gyro; and computing means for deriving from the first sensor while the drillstring is rotating the inclination angle of the drillstring at the instrument package, and for deriving from the second sensor while the drillstring is rotating the azimuth angle of the drillstring at the instrument package.

The computing means preferably operates to integrate the sensor outputs over the four quadrants of rotation and to derive the desired output angle from the integrated output.

The apparatus may further include rotation angle reference means for use in the integration.

Examples of the present invention will now be described, by way of illustration only, with reference to the drawings, in which:

FIG. 2 is a block diagram of one circuit which may be used to identify rotation quadrant;

FIG. 3 illustrates the operation where the sensor is an accelerometer;

SINGLE-AXIS SENSOR

The operation of a single-axis sensor in a drill string will first be described in general terms. The application of this to specific sensors is discussed below.

Figure 1:
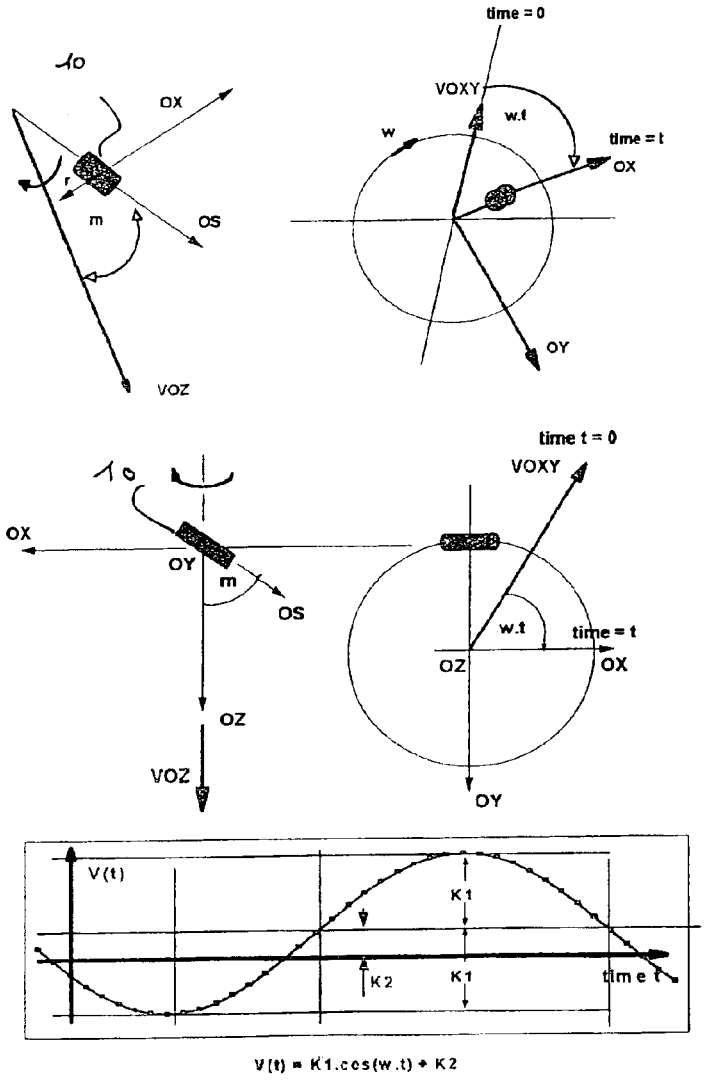
FIG. 1 illustrates, in general terms, the operation of a single axis sensor in a drillstring for sensing any given vector V.

Referring to FIG. 1, a single-axis sensor 10 is mounted on a drill string (not shown). The sensor 10 senses a fixed vector {V} and is mounted in one of two configurations.

In the first configuration, the sensor 10 lies in a plane containing the rotation axis (OZ) of the drill string and axis (OX) perpendicular to (OZ). Axis (OY) makes up the conventional orthogonal set of axes [OX,OY,OZ]. The sensor 10 is mounted at a distance r from the (OZ) axis and the angle between the sensing axis (OS) and the rotational axis (OZ) is m.

In the second configuration, the sensor 10 is mounted in a plane which is parallel to the borehole axis (OZ) and with its sensing axis perpendicular to the axis (OY) and making angle m with the direction of the borehole axis (OZ).

If the rate of rotation about the (OZ) axis is w and the components of {V} are {VOZ} along the (OZ) axis direction and {VOXY} in the (OXY) plane, then if the output from the sensor 10 for both configuration 1 and configuration 2 of FIG. 1 is of the form $$V(t)=VOZ.\ \cos(m)+VOXY.\ \sin(m).\ \cos(w.t)+c$$

where time t=0 when the axis (OX) is coincident with the direction of {VOXY} and c is constant for any fixed rotation rate w.

Thus, the sensor output at time t can be written:

$$V(t)=K1.\ \cos(w.t)+K2 \qquad \text{(i)}$$

where K1=VOXY. sin(m) and K2=VOZ. cos(m)+c are constant if the vector amplitudes VOZ and VOXY are constant.

Sensor Output Integration

The integration of V(t) from any initial time ti to ti+T/4, where T=2.π/w, the time for one revolution about (OZ), is $$Q = \int_{ti}^{ti+T/4} K1 \cdot \cos(w \cdot t) \cdot dt + \int_{ti}^{ti+T/4} K2 \cdot dt$$

Thus, $$Q=[(K1/w).\ \sin(w.t)]_{ti}^{ti+T/4}+K2.T/4$$

or $$Q=(K1/w).[\sin(w.ti+w.T/4)-\sin(w.ti)]+L$$

or $$Q=(K1/w).[\sin(w.ti+\pi/2)-\sin(w.ti)]+L$$

or $$Q=(K1/w).[\cos(w.ti)-\sin(w.ti)]+L \quad \text{(ii)}$$

where L is a constant=K2.T/4.

Using equation (ii), the integration of V(t) from an arbitrary time t0 to time t0+T/4 yields $$Q1=(K1/w).[\cos(w.to)-\sin(w.to)]+L \quad \text{(iii)}$$

Using equation (ii), the integration of V(t) from time t0+T/4 to time t0+T/2 yields $$Q2=(K1/w).[\cos(w.t0+w.T/4)-\sin(w.t0+w.T/4)]+L$$

or $$Q2=(K1/w).[\cos(w.t0+\pi/2)-\sin(w.t0+\pi/2)]+L$$

or $$Q2=(K1/w).[-\sin(w.t0)-\cos(w.t0)]+L \quad \text{(iv)}$$

Using equation (ii), the integration of V(t) from time t0+T/2 to t0+3T/4 yields $$Q3=(K1/w).[\cos(w.t0+w.T/2)-\sin(w.t0+w.T/2)]+L$$

or $$Q3=(K1/w).[\cos(w.t0+\pi)-\sin(w.t0+\pi)]+L$$

or $$Q3=(K1/w).[-\cos(w.t0)+\sin(w.t0)]+L \quad \text{(v)}$$

Using equation (ii), the integration of V(t) from time t0+3T/4 to time t0+T yields $$Q4=(K1/w).[\cos(w.t0+w.3T/4)-\sin(w.t0+w.3T/4)]+L$$

or $$Q4=(K1/w).[\cos(w.t0+3\pi/2)-\sin(w.t0+3\pi/2)]+L$$

or $$Q4=K1/w).[\sin(w.t0)+\cos(w.t0)]+L \quad \text{(vi)}$$

Writing K=K1/w and α=w.t0, then equations (iii) through (vi) yield for the four successive integrations of V(t)

$$Q1=-K.\ \sin\alpha+K.\ \cos\alpha+L \quad \text{(vii)}$$

$$Q2=-K.\ \sin\alpha-K.\ \cos\alpha+L \quad \text{(viii)}$$

$$Q3=K.\ \sin\alpha-K.\ \cos\alpha+L \quad \text{(ix)}$$

$$Q4=K.\ \sin\alpha+K.\ \cos\alpha+L \quad \text{(x)}$$

Integration Control

In order to control the sensor output integration, as just described, over four successive quarter periods of the drill string rotation, a train of n (with n any multiple of 4) equally spaced pulses per revolution must be generated. If one pulse $P_0$ of this pulse train is arbitrarily chosen at some time t0, the repeated pulses $P_{n/4}$, $P_{n/2}$ and $P_{3n/4}$ define times t0+T/4, t0+T/2 and t0+3T/4 respectively where the period of rotation T=2π/w and w is the angular velocity of rotation.

A suitable means for generating an appropriate control pulse train is described in US-A1-20020078745, which is hereby incorporated by reference.

In an alternative form of integration control, the sensor output waveform itself can be used with appropriate circuitry for defining the integration quadrant periods. In particular, the relatively low noise magnetic fluxgate output is well suited to act as input to a phase-locked-loop arrangement. FIG. 2 shows such an arrangement, successive output pulses defining the integration quadrants.

Rotation Angle

Equations (vii) through (x) can be solved to yield angle α; there is a degree of redundancy in the possible solutions but, for example, $$Q1-Q2=2K.\ \cos\alpha$$

and $$Q3-Q2=2K.\ \sin\alpha$$

or $$\sin\alpha/\cos\alpha=(Q3-Q2)/(Q1-Q2) \quad \text{(xi)}$$

Since α=w.t0, the angle S(t0) between the axis (OX) and the direction of {VOXY} at time t0 can be determined from equation (xi), and the angle between (OX) and {VOXY} at any time tm measured from the arbitrary starting time t0 is then $$S(tm)=\alpha+w.tm=S(t0)+2\pi.tm/T \quad \text{(xii)}$$

Magnitudes of Vectors {VOXY} and {VOZ}

Equations (vii) through (x) can be solved to yield the constant L:

$$L=(Q1+Q2+Q3+Q4)/4 \quad \text{(xiii)}$$

and the constant K can be determined from:

$$(K)^2=[(Q1-L)^2+(Q2-L)^2]/2=[(Q3-L)^2+(Q4-L)^2]/2 \quad \text{(xiv)}$$

The magnitude of vector {VOZ} can be determined as $$VOZ=(K2-c)/\cos(m)=(4.L/T-c)/\cos(m) \quad \text{(xv)}$$

provided that constant c is known.

The magnitude of vector {VOXY} can be determined as $$VOXY=K1/\sin(m)=(K.w)/\sin(m) \quad \text{(xvi)}$$

Inclination Angle

The inclination angle (INC) can be derived from the gravity vector {G} with the aid of a rotating accelerometer.

Referring to FIG. 3, where (INC) is the angle between the tool axis (OZ) and the gravity vector {G}, $$GOZ=G.\ \cos(INC) \quad \text{(xvii)}$$

and $$GOXY=-G\ \sin(INC) \quad \text{(xviii)}$$

The accelerometer output can be written as $$VG(t)=GOZ.\ \cos(m)+GOXY.\ \sin(m).\ \cos(wt)+CP.\ \sin(m)+D.\ \sin(m) \quad \text{(xix)}$$

where CP is a centripetal acceleration term and D is a sensor datum term. The centripetal acceleration term CP is zero for configuration 2 and makes this the preferred configuration for mounting of the accelerometer.

Since CP is proportional to $w^2/r$ and is constant for constant w, then clearly VG(t) is of the form $$VG(t)=K1.\ \cos(w.t)+K2(w)\ (\text{or } K1.\ \cos(w.t)+K2 \text{ for configuration 2}) \quad \text{(xx)}$$

where K1 and K2(w) are constants at constant angular velocity w in the case of configuration 1 and always constant in the case of configuration 2. the constants K1 and K2(w) can be determined from the accelerometer output integrations as described above together with the angle (Highside Angle HS=w.t) between the axis (OX) and the direction of {GOXY}.

$$K1=GOXY.\ \sin(m) \quad \text{(xxi)}$$

and $$K2(w)=GOZ.\ \cos(m)+D.\ \sin(m) \quad \text{(xxii)}$$

with $$C(w)=CP.\ \sin(m)+D.\ \sin(m) \quad \text{(xxiii)}$$

constant at constant angular velocity w (or for configuration 2 at all w).

A calibration procedure can be carried out to determine the values of C(w) for angular velocity values w (constant in the case of configuration 2) by calculating values of K2(w) with the rotation axis (OZ) horizontal when C(w)=K2(w).

Thus, for any drilling situation with known angular velocity w, the vector components of the local gravity vector {G} can be determined as $$GOXY=K1/\sin(m) \quad \text{(xxiv)}$$

and $$GOZ=(K2(w)-C(w))/\cos(m) \quad \text{(xxv)}$$

The inclination angle (INC) can then be determined from $$\sin(INC)/\cos(INC)=-GOXY/GOZ \quad \text{(xxvi)}$$

Azimuth Angle

When using a rotating fluxgate, the azimuth angle (AZ) can be determined from a consideration of the magnetic vector {B}. What follows is applicable to both configuration 1 and configuration 2.

Figure 4:
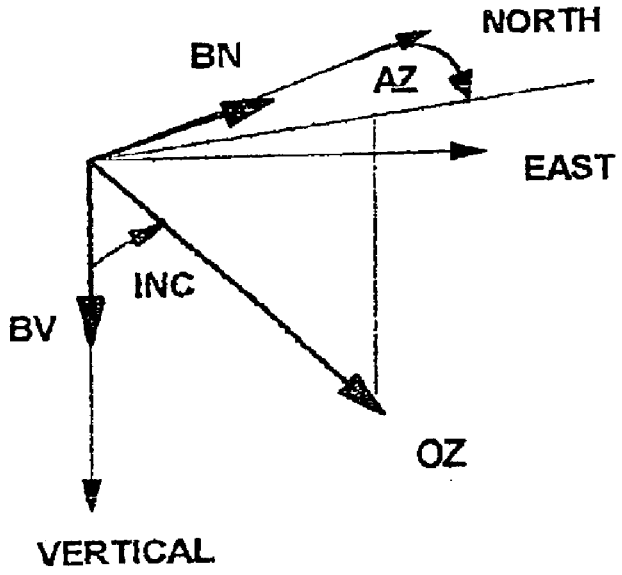
FIG. 4 illustrates the operation where the sensor is a fluxgate.

With reference to FIG. 4, it can be shown that $$BOZ=BV.\ \cos(INC)+BN.\ \cos(AZ).\ \sin(INC) \quad \text{(xxvii)}$$

and $$BOXY=(BN.\ \cos(AZ).\ \cos(INC)-BV.\ \sin(INC)).\ \cos(HS-MS)+BN.\ \sin(AZ).\ \sin(HS-MS) \quad \text{(xxviii)}$$

or, with HS−MS=d a constant, $$BOXY=(BN.\ \cos(AZ).\ \cos(INC)-BV.\ \sin(INC)).\ \cos(d)+BN.\ \sin(AZ).\ \sin(d) \quad \text{(xxix)}$$

With D the fluxgate datum, the fluxgate output can be written $$VB(t)=BOZ.\ \cos(m)+BOXY.\ \sin(m).\ \cos(w.t)+D.\ \sin(m) \quad \text{(xxx)}$$

or $$VB(t)=K1.\ \cos(w.t)+K2 \quad \text{(xxxi)}$$

where $$K1=BOXY.\ \sin(m)$$

and $$K2=BOZ.\ \cos(m)+D.\ \sin(m)=BOZ.\ \cos(m)+C \quad \text{(xxxii)}$$

are constants which can be determined from the fluxgate output integrations as described above together with the angle (Magnetic Steering Angle=MS=w.t) between the axis (OX) and the direction of {BOXY}.

A calibration procedure can be carried out to determine the value of the constant C by calculating the value of K2 while rotating about the direction of the axis (OZ) along which BOZ=0 when K2=C.

Thus, for any drilling situation the vector components of the local magnetic field {B} can be determined as $$BOXY=K1/\sin(m) \quad \text{(xxxiii)}$$

and $$BOZ=(K2-C)/\cos(m) \quad \text{(xxxiv)}$$

Figure 5:
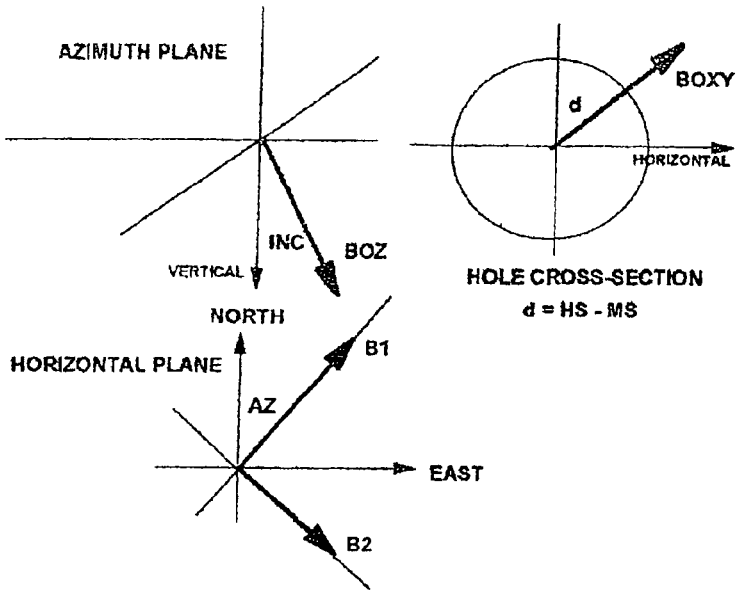
FIG. 5 illustrates the derivation of azimuth angle.

With reference to FIG. 5, the horizontal component {BN} of the local magnetic field vector {B} can be represented by horizontal components {B1} and {B2} where $$B1=BOXY.\ \cos(d).\ \cos(INC)+BOZ.\ \sin(INC) \quad \text{(xxxv)}$$

and $$B2=BOXY.\ \sin(d) \quad \text{(xxxvi)}$$

The Azimuth Angle (AZ) can then be determined from $$\sin(AZ)/\cos(AZ)=-B2/B1 \quad \text{(xxxvii)}$$

Also, the horizontal component of the local magnetic field can be determined from $$BN=(B1^2+B2^2)^{3/2} \quad \text{(xxxviii)}$$

and the vertical component of the local magnetic field can be determined from $$BV=BOZ.\ \cos(INC)-BOXY.\ \cos(d).\ \sin(INC) \quad \text{(xxxix)}$$

Earth's Rotation Vector

Where it is not practicable to use a magnetic fluxgate, this may be replaced by a rate gyro as sensor.

Figure 6:
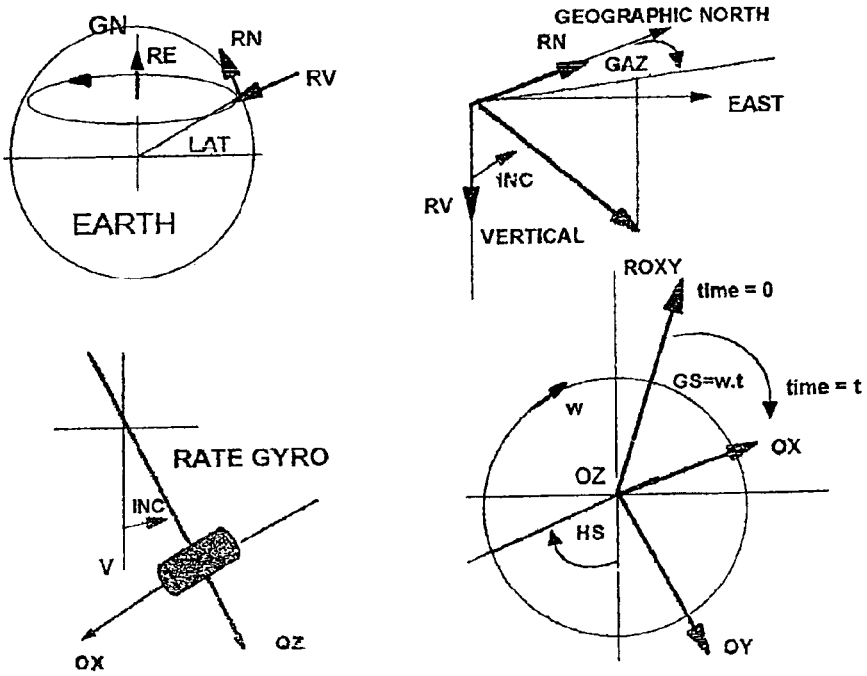
FIG. 6 illustrates the operation where the sensor is a rate gyro.

With reference to FIG. 6, if the geographic latitude at the drilling location is (LAT) then the vertical component of the earth's Rotation Vector {RE} is $$RV=-RE.\ \sin(LAT) \quad \text{(xl)}$$

and the horizontal component is $$RN=RE.\ \cos(LAT) \quad \text{(xli)}$$

The magnitude of the cross-axis rate vector {ROXY} can be shown to be $$ROXY=(RN.\ \cos(GAZ).\ \cos(INC)-RV.\ \sin(INC)).\ \cos(d)+RN.\ \sin(GAZ)\sin(d)$$

where (GAZ) is the gyro azimuth angle and d=HS−GS is constant.

Since RN, RV, d and INC are known and ROXY can be derived as discussed below, (GAZ) can be determined.

With the particular configuration where the rate gyro sensing axis is perpendicular to the drill string rotation axis (OZ), the rate gyro output can be written $$VG(t)=ROXY.\ \cos\ (w.t)+D \quad \text{(xliii)}$$

where D is the rate gyro datum, or $$VG(t)=K1.\ \cos(w.t)+K2 \quad \text{(xliv)}$$

where the constant K1=ROXY can be determined from the rate gyro output integrations as described above together with the Gyro Steering Angle GS=w.t between (OX) and the direction of {ROXY}.

The variation in the Rate Gyro Datum makes it difficult to achieve satisfactory datum calibration in all circumstances. It is unlikely that Gyro Azimuth measurements should be attempted at high inclination angles. The use of the rate gyro is most likely with near-vertical boreholes in locations where magnetic azimuth measurements are unreliable (such as close to rigs) and the Gyro Azimuth GAZ is approximately equal to the angle d.

The present invention thus makes possible the measurement of a number of borehole-related parameters during rotation of a drillstring and using a reduced number of sensors. Modifications may be made to the foregoing embodiments within the scope of the present invention.

What is claimed is:

1. A method of surveying boreholes, comprising:

providing an instrument package in a leading end of a drillstring, said instrument package comprising first and second single-axis sensors mounted for rotation with the drillstring about the rotational axis of the drillstring, the first sensor being an accelerometer and the second sensor being a magnetic fluxgate or a rate gyro;

rotating the drillstring;

deriving solely from the first sensor the inclination angle of the drillstring at the instrument package; and deriving solely from the first sensor and the second sensor the azimuth angle of the drillstring at the instrument package.

2. The method of claim 1, wherein the sensors are radially spaced from the borehole axis and have their sensing axes in a plane containing the borehole axis and an axis perpendicular thereto.

3. The method of claim 1, wherein the sensors are radially spaced from the borehole axis and have their sensing axes in a plane parallel with the borehole axis.

4. The method of claim 1, wherein the drilling control rotation angle is obtained from the outputs of the sensors.

5. The method of claim 1, wherein the outputs of the sensors are integrated over each of the four quadrants of rotation and the desired output angle is derived from the integrated output.

6. The method of claim 1, wherein the instrument package suitably includes rotation angle reference means for use in the integration.

7. The method of claim 1, wherein additional information is derived comprising the local gravitational and magnetic field vectors.

8. An apparatus for use in surveying boreholes, the apparatus comprising:

an instrument package adapted to be included in the leading end of drillstring, the instrument package comprising first and second single-axis sensors mounted for rotation with the drillstring about the rotational axis of the drillstring, the first sensor being an accelerometer and the second sensor being a magnetic fluxgate or rate-gyro; and computing means for deriving solely from the first sensor while the drillstring is rotating the inclination angle of the drillstring at the instrument package, and or deriving solely from the first sensor and the second sensor while the drillstring is rotating the azimuth angle of the drillstring at the instrument package.

9. The apparatus of claim 8, wherein the sensors are radially spaced from the borehole axis and have their sensing axes in a plane containing the borehole axis and an axis perpendicular thereto.

10. The apparatus of claim 8, wherein the sensors are radially spaced from the borehole axis and have their sensing axes in a plane parallel with the borehole axis.

11. The apparatus of claim 8, wherein the computing means operates to integrate the outputs of the sensors over each of the four quadrants of rotation and to derive the desired output angle from the integrated outputs.

12. The apparatus of claim 8, further comprising rotation means for use in the integration.

* * * * *